United States Patent [19]

Hanson

[11] Patent Number: 4,551,109

[45] Date of Patent: Nov. 5, 1985

[54] MALLEABLE MATERIAL VEHICLE PLAYSET

[75] Inventor: Steven P. Hanson, Winnetka, Ill.

[73] Assignee: Marvin Glass & Associates, Chicago, Ill.

[21] Appl. No.: 693,385

[22] Filed: Jan. 22, 1985

[51] Int. Cl.[4] ..... A63H 17/00

[52] U.S. Cl. ..... 446/95; 446/465

[58] Field of Search ..... 446/431, 465, 470, 471, 446/491, 85, 86, 93, 94, 95, 96, 88, 385

[56] References Cited

U.S. PATENT DOCUMENTS 2,620,192 12/1952 Housley ..... 446/93 X
3,654,727 4/1972 Span et al. ..... 446/94
3,670,450 6/1972 Morosawa ..... 446/95 X

FOREIGN PATENT DOCUMENTS 1409814 12/1965 France ..... 446/73

*Primary Examiner*—Mickey Yu
*Attorney, Agent, or Firm*—John S. Pacocha

[57] ABSTRACT

A children's activity playset for building vehicles using a malleable material includes a chassis carrying free wheeling axle and wheel assemblies on the underside. Clear plastic body shells are provided for filling with colored malleable materials and then pressing on top of the chassis. Upwardly projecting posts on the chassis help secure the malleable material to the chassis. Once assembled the clear shell may be removed or left on the vehicle to protect it during play.

5 Claims, 6 Drawing Figures

MALLEABLE MATERIAL VEHICLE PLAYSET

BACKGROUND OF THE INVENTION

1. Field of the Invention

This invention relates generally to a children's activity playset and more particularly to a playset using a malleable material such as clay.

2. Background Art

Toy vehicles or cars have long been popular playthings. Clay and other malleable materials have been used both for entertaining and educational activities for children as well as in adult endeavors such as the making of new automobile styling models. Although children may well find it enjoyable and perhaps educational to emulate such adult activities, they often do not have the necessary dexterity and talent to create an aesthetically pleasing three dimensional model from a malleable material. Molds have been provided in the prior art, such as disclosed in U.S. Pat. No. 3,574,968 for facilitating the creation of three dimensional models using malleable materials. Nevertheless, there remains a need for a children's activity playset that permits a child to build a model of a vehicle with some individual creativity out of a malleable material such as clay and it would also be desirable if the child could then play with the finished product.

SUMMARY OF THE INVENTION

The present invention is concerned with providing a children's activity playset with which a child can create a three dimensional model, such as that of a car, using a malleable material and obtain an aesthetically pleasing finished product displaying the child's individual creativity as well as be able to play with that individually created model. These and other objects and advantages of the invention are achieved by providing a vehicle chassis carrying freewheeling axle and wheel assemblies on the underside with upwardly projecting posts on the top side of the chassis. Clear plastic body shells are provided for filling with differently colored malleable materials such as clay. The filled shells are pressed over the chassis and retained by engagement of the upwardly projecting posts. After completion, the clear shell may be removed or left on to protect the finished model during further play.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
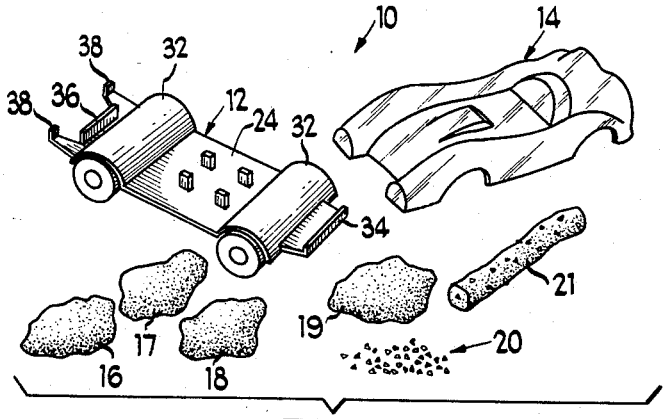
FIG. 1 is a perspective view of components of an embodiment of the present invention.

Referring now the drawing in which like parts are designated by like reference numerals throughout the several views, there is shown in FIG. 1 an activity playset 10 that includes a chassis 12, transparent shell 14, differently colored malleable materials 16, 17, 18 and 19 plus glitter 20. Playset 10 may also include additional clear shells (not shown) of different styles but still compatible with chassis 12. As is illustrated in FIG. 1 a malleable material may be combined with the glitter to form a composite 21.

Chassis 12 includes a frame or armature 24 that has a pair of spaced apart, substantially parallel, sleeves 26 extending across the width. Each of the sleeves receives an axle 28 for rotation. Mounted on each end of each axle for rotation with the axle is a wheel 30. The frame or armature includes a generally semicylindrical portion 32 covering each of the front and rear freewheeling axle and wheel assemblies.

Figure 3:
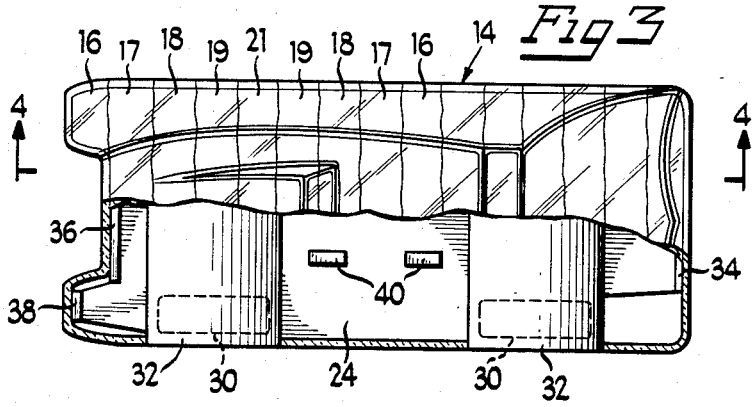
FIG. 3 is an enlarged scale, top plan view, partially in section, of the assembled components shown in FIG. 2.
Figure 5:
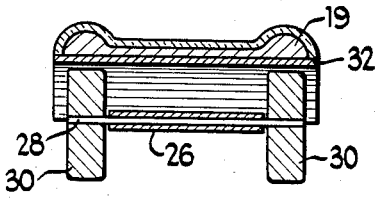
FIG. 5 is a sectional view taken generally along the line 5—5 of FIG. 4.
Figure 4:
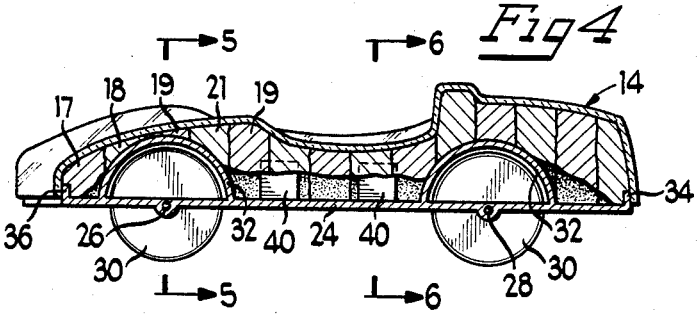
FIG. 4 is a sectional view taken generally along the line 4—4 of FIG. 3.
Figure 6:
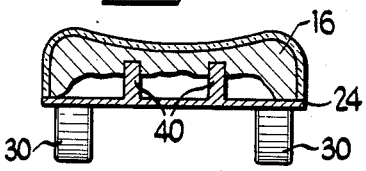
FIG. 6 is a sectional view taken generally along the line 6—6 of FIG. 4.

Extending out beyond the rear axle and wheel protective shell 32, the rear portion of the frame terminates in a short upwardly projecting lip 34. The portion of the frame projecting beyond the front semicylindrical shell portion 32 also has a centrally disposed upwardly projecting lip 36 plus two, more forwardly extending projecting side lips 38 on either side of center lip 36. As is best illustrated in FIGS. 3 and 4, shell 14 fits over the chassis 12 with depending peripheral portions overlapping the outside of upwardly projecting lips 34, 36 and 38.

Projecting up from the central, open area of frame 24 are a series of spaced apart posts 40. Shell 14 is sufficiently deep in the areas into which the posts 40 project to accommodate a sufficient amount of malleable material to cover the tops of the posts as shown in FIG. 4.

A child may build a model car out of clay or other malleable material by filling shell 14 with a desired combination of differently colored malleable material. Thus, for example, as illustrated in the drawing, the child may initially roll out the malleable materials into roughly cylindrical pieces similar to the clay and glitter composite 21 shown in FIG. 1. The pieces are then laid in differently colored strips extending transversely across the shell. Numerous other alternative individual creations, such as using one color of material in the fender areas and another color of material for the hood, trunk, etc. may be achieved.

Figure 2:
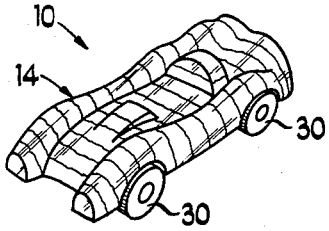
FIG. 2 is a perspective view of the assembled components.

When shell 14 is filled, excess material may be trimmed from the bottom and the filled shell then pressed over the chassis 12 forcing upwardly projecting posts 40 into the malleable material to help secure the shell, malleable material and chassis together. The completed assembly, as illustrated in FIG. 2 provides the child with a individually styled car which may then be rolled along a substantially flat surface on the free wheeling axle and wheel assemblies. Semicylindrical wells 32 protect the axle and wheel assemblies from becoming clogged with the malleable materials. Shell 14 may be removed once the model is completed or, alternatively may be left on as a protective cover. As the child becomes more adept at constructing model vehicles, the body of malleable materials may be built up directly on frame or armature 12 and shell or cover 14 applied over the finished model.

While a particular embodiment of the present invention has been shown and described with some changes and modifications, it will be apparent to those skilled in the art that further changes and modifications may be made without departing from the true spirit and scope of the present invention. It is intended in the following claims to cover all such changes and modifications.

What is claimed as new and desired to be secured by Letters Patent:

1. A children's activity playset comprising in combination:

a supply of malleable materials;

a chassis carrying free wheeling axle and wheel assemblies on the underside; and a transparent body shell fitting over the chassis.

2. The children's activity playset of claim 1 including a plurality of posts projecting upwardly from the top side of the chassis.

3. The children's activity playset of claim 2 in which the depth of the shell is sufficient to accommodate each post plus a sufficient thickness of the malleable material atop each post to obscure each post.

4. The children's activity playset of claim 1 in which the chassis includes portions shielding the freewheeling axle and wheel assemblies from malleable materials applied atop the chassis.

5. The children's activity playset of claim 1 in which the chassis includes upwardly extending end lips ahd the shell has downwardly depending sides overlapping the lips.

* * * * *